US012529282B2

(12) United States Patent
Zeng et al.

(10) Patent No.: US 12,529,282 B2
(45) Date of Patent: Jan. 20, 2026

(54) WATER INJECTION REGULATION SYSTEM AND METHOD FOR WATER INJECTION WELL

(71) Applicants: CHINA PETROLEUM & CHEMICAL CORPORATION, Beijing (CN); SINOPEC EXPLORATION & PRODUCTION RESEARCH INSTITUTE, Beijing (CN)

(72) Inventors: Hao Zeng, Beijing (CN); Haibo Wang, Beijing (CN); Wenqi Ke, Beijing (CN); Lihong Yang, Beijing (CN); Xueqi Cen, Beijing (CN); Jingfei Tang, Beijing (CN); Xiaolong Li, Beijing (CN)

(73) Assignees: CHINA PETROLEUM & CHEMICAL CORPORATION, Beijing (CN); SINOPEC EXPLORATION & PRODUCTION RESEARCH INSTITUTE, Beijing (CN)

( * ) Notice: Subject to any disclaimer, the term of this patent is extended or adjusted under 35 U.S.C. 154(b) by 0 days.

(21) Appl. No.: 18/834,784

(22) PCT Filed: Dec. 15, 2022

(86) PCT No.: PCT/CN2022/139235
§ 371 (c)(1),
(2) Date: Jul. 31, 2024

(87) PCT Pub. No.: WO2023/160147
PCT Pub. Date: Aug. 31, 2023

(65) Prior Publication Data

US 2025/0137341 A1 May 1, 2025

(30) Foreign Application Priority Data

Feb. 28, 2022 (CN) ..... 202210189059.4

(51) Int. Cl.
*E21B 33/068* (2006.01)
*E21B 43/20* (2006.01)
(Continued)

(52) U.S. Cl.
CPC ..... *E21B 33/068* (2013.01); *E21B 43/20* (2013.01); *E21B 47/138* (2020.05); *E21B 47/26* (2020.05)

(58) Field of Classification Search
CPC ..... E21B 43/162; E21B 33/068; E21B 43/20; E21B 47/138; E21B 47/26
See application file for complete search history.

(56) References Cited

U.S. PATENT DOCUMENTS 6,241,028 B1 * 6/2001 Bijleveld ..... E21B 47/00 175/40
6,324,904 B1 * 12/2001 Ishikawa ..... E21B 47/017 257/E29.022
(Continued)

FOREIGN PATENT DOCUMENTS

CN 202467796 U 10/2012
CN 106988734 A 7/2017
(Continued)

OTHER PUBLICATIONS

Tan, Shaoxu et al.; "Application of Intelligent Water Injection and Completion Technology in Bohai Oilfield"; China Petroleum Machinery; vol. 47, No. 4; Year: 2019; pp. 63-68.

*Primary Examiner* — Robert E Fuller
(74) *Attorney, Agent, or Firm* — NKL Law; Allen Xue

(57) ABSTRACT

A water injection regulation system for water injection well has a float limiting device (A) provided at a wellhead configured to release and capture a float; a ground water delivery device (B) having an outlet in communication with the float limiting device (A), and is configured to inject water into well through the float limiting device (A); and a plurality of downhole water distribution devices, each arranged in a target layer and outside a sidewall of a water-injection string, and configured to monitor production data of the target layer. The float is configured to receive a
(Continued)

water distribution instruction to regulate water distribution of each downhole water distribution device, enter the water-injection string (11) with water flow, and float upwards to the wellhead after completing data collection. Each downhole water distribution device is configured to exchange the production data with the water distribution instruction carried by the float.

12 Claims, 5 Drawing Sheets

(51) Int. Cl.
*E21B 47/12* (2012.01)
*E21B 47/26* (2012.01)

(56) References Cited

U.S. PATENT DOCUMENTS

| | | | | |
|---|---|---|---|---|
| 9,366,134 | B2 * | 6/2016 | Walton | E21B 34/066 |
| 9,828,851 | B1 * | 11/2017 | Bonavides | E21B 47/26 |
| 10,508,536 | B2 * | 12/2019 | Morrow | E21B 47/12 |
| 10,653,027 | B2 * | 5/2020 | van Pol | G01D 11/245 |
| 10,662,759 | B2 * | 5/2020 | Shi | E21B 47/06 |
| 10,844,694 | B2 * | 11/2020 | Gooneratne | E21B 47/00 |
| 10,900,351 | B2 * | 1/2021 | Deffenbaugh | E21B 47/138 |
| 11,708,758 | B2 * | 7/2023 | Jabari | E21B 49/0875 166/264 |
| 11,788,404 | B2 * | 10/2023 | Bustos | E21B 43/26 166/250.01 |
| 11,913,329 | B1 * | 2/2024 | Zeghlache | E21B 47/26 |
| 2007/0272411 | A1 * | 11/2007 | Lopez De Cardenas | E21B 43/14 166/305.1 |
| 2009/0146835 | A1 * | 6/2009 | Xu | E21B 41/00 340/854.3 |
| 2017/0159417 | A1 | 6/2017 | Schuur et al. | |

FOREIGN PATENT DOCUMENTS

| | | | |
|---|---|---|---|
| CN | 209067183 | U | 7/2019 |
| CN | 209603955 | U | 11/2019 |
| CN | 110735621 | A | 1/2020 |
| CN | 111927361 | A | 11/2020 |
| CN | 213392117 | U | 6/2021 |

* cited by examiner

WATER INJECTION REGULATION SYSTEM AND METHOD FOR WATER INJECTION WELL

TECHNICAL FIELD

The present invention relates to the technical field of oil/gas field development, and specifically to a water injection regulation system and method for a water injection well.

TECHNICAL BACKGROUND

In the later stage of oil field development, water injection is an important method for reservoir energy supplement. However, due to interlayer contradiction in the reservoir, general water injection will lead to uneven water absorption between layers, which cannot produce desirable water displacement. Therefore, layered water injection technology is of considerable importance. Layered water injection technology has gone through development stages of fixed layered water injection, movable layered water injection, eccentric layered water injection, bridge concentric layered water injection, and the latest generation of intelligent layered water injection.

Conventional layered water injection requires wireline operations to realize layered regulation, which is time-consuming and inefficient. In the meantime, downhole intelligent control devices mostly use cables for power supply and data transmission, resulting in complicated tripping process and high operation cost. Existing downhole intelligent water injection devices typically use electromagnetic waves or pressure pulses for command control and data transmission, which can be greatly affected by wellbore and formation conditions, and present poor adaptability to complex and deep reservoirs as well as complex well structures. Therefore, there is a need for a downhole intelligent data-transmission method which is less impacted by the environment with high data transmission efficiency, as well as a corresponding intelligent water injection system which has high stability, low construction difficulty, low operating cost, and dispenses with frequent maintenance.

Therefore, there is a need in the field for a water injection regulation method for a water injection well whereby one or more of the above technical problems can be effectively solved.

SUMMARY OF THE INVENTION

Aiming to solve the above technical problems, the present invention proposes a water injection regulation system for a water injection well, which comprises a float limiting device provided at a wellhead, which is configured to release a float upon receiving an activation instruction, and automatically capture the float floating up to the wellhead; a ground water delivery device, which has an outlet in communication with an interior of the float limiting device, and is configured to inject water into the well through the float limiting device; and a plurality of downhole water distribution devices, each of which is arranged in a target layer and on a sidewall of a water-injection string, and configured to monitor production data of the target layer, wherein the float is configured to receive a water distribution instruction to regulate water distribution of each downhole water distribution device under water distribution condition, enter the water-injection string with water flow after being released, and spontaneously float upwards to the wellhead after data collection is completed, and each of the downhole water distribution devices is configured to transmit the production data to the float and receive the water distribution instruction carried by the float when detecting the float, in order to perform water distribution regulation according to the water distribution instruction.

Preferably, the float limiting device comprises a wellhead device in communication with the outlet of the ground water delivery device, with a bottom portion thereof in communication with the wellhead, for accommodating the float at the wellhead; a capture device provided at an upper end portion of the wellhead device, for restricting and releasing the float; and a wellhead signal-exchange device, which is arranged on the capture device and outside the wellhead device, and configured to communicate with the float so that the float receives the water distribution instruction, and to access the production data collected by the float.

Preferably, the wellhead signal-exchange device is further configured to communicate with the capture device, for sending the activation instruction to the capture device under the water distribution condition, detecting whether the float is close to the capture device in real time, and generating a capture instruction when the float is detected, thereby sending the capture instruction to the capture device.

Preferably, the float comprises a pressure-bearing housing; a first signal transceiver device provided within the pressure-bearing housing and configured to continuously emit a first detection signal; a first data storage and processing device provided within the pressure-bearing housing, which is connected to the first signal transceiver device, and configured to communicate, when approaching the downhole water distribution device arranged in the target layer, with said downhole water distribution device in a wireless manner through the first signal transceiver device, thereby realizing the exchange of the water distribution instruction between the downhole water distribution device and the float; and an insulating filling portion within the pressure-bearing housing.

Preferably, the downhole water distribution device comprises a water distribution body provided on a sidewall of the water-injection string, with both ends thereof provided with an upper interface and a lower interface, respectively; a water injection outlet in communication with the water-injection string and arranged on a sidewall of the water distribution body; a second signal transceiver device; a second data storage and processing device, which is connected to the second signal transceiver device and configured to communicate in a wireless manner with the float when the first detection signal is detected, thereby realizing information exchange between the water distribution instruction and the production data; and a power device, which is connected to both the water injection outlet and the second data storage and processing device, and configured to regulate a flow rate and/or size of the water injection outlet according to the water distribution instruction.

Preferably, the water injection regulation system further comprises an anti-escape device, which is provided at a bottom of the string and configured to prevent the float from escaping the string after the float passes through all downhole water distribution devices with water flow.

Preferably, a through hole is formed between a top portion and a bottom portion of the anti-escape device along its center axis, wherein each of longitudinal edges on both sides of the through hole in its axial cross-section has a parabolic shape with an opening facing outward, the through hole having a minimum inner diameter smaller than an outer diameter of the float, and a maximum inner diameter larger than the outer diameter of the float.

Preferably, the ground water delivery device comprises a first water injection line, an outlet thereof being in communication with a sidewall of the wellhead device in the float limiting device, and configured to be in communication with the wellhead device under a water injection condition and blocked from the sidewall of the wellhead device under the water distribution condition; and a second water injection line, which has a first end in communication with a sidewall of the first water injection line, and a second end which is in communication with the sidewall of the wellhead device in the float limiting device and configured to be in communication with the wellhead device under the water distribution condition.

Preferably, the ground water delivery device further comprises a first injection valve arranged adjacent to an inlet of the first water injection line; a second injection valve within the second water injection line; and a third injection valve arranged adjacent to the outlet of the first water injection line.

Preferably, the float limiting device is further configured to monitor a dynamic pressure in the system to determine a timing when the float reaches the bottom of the string, based on which an instruction to stop water injection is generated, so that a water injection device stops water injection.

Preferably, the float is further configured to move, after the water injection device stops water injection, from the bottom of the string to the wellhead in still water under buoyancy.

According to another aspect of the present invention, a water injection regulation method for a water injection well is proposed, which is performed by means of the water injection regulation system, characterized in that the water injection regulation method comprises steps of:

- connecting the ground water delivery device with the float limiting device, and injecting water into the well through the float limiting device;
- receiving, by the float, a water distribution instruction to regulate water distribution for each downhole water distribution device in water distribution condition;
- releasing the float by the float limiting device upon receiving an actuation instruction, wherein the float then enters the water injection string along with water flow;
- monitoring the production data of the target layer through the downhole water distribution device provided at the target layer and on the sidewall of the water injection string, and upon detecting the float, transmitting the production data to the float and transmitting the water distribution instruction carried by the float to the downhole water distribution device, so that water distribution regulation is carried out according to the water distribution instruction; floating the float up to the wellhead; and
- automatically capturing the float by the float limiting device after completing data collection.

Compared with the prior arts, one or more of the embodiments in the above technical solutions have the following advantages or advantageous effects.

The present invention proposes a water injection regulation system and method for a water injection well. The system and method can achieve intelligent water injection regulation through carrying out downhole data transmission and water injection regulation by means of an intelligent float, thus realizing intelligent real-time wireless measurement and regulation as well as data monitoring for each water injection section of a layered water injection well. With a special downhole data and signal bidirectional transmission method, the present invention shortens distances of data transmission and signal control, so that exchange and transmission for data and instructions are less affected by the environment, allowing for faster and more stable data exchange. Therefore, the present invention is able to solve the problems concerning electromagnetic waves, pulse conductions and other technologies in existing wireless-transmission measurement and regulation devices that are easily affected by environmental factors and have limited applicable depth, and thus is of practical significance for high-efficiency and low-cost intelligent oil field.

Other features and advantages of the present invention will be set forth in the description which follows, and, in part, will be apparent from the description, or may be learned from the implementation of the present invention. The objective and other advantages of the present invention may be realized and attained from the structure particularly pointed out in the description, claims and drawings.

BRIEF DESCRIPTION OF THE DRAWINGS

The accompanying drawings are used to provide a further understanding on the present invention, and constitute a part of the description. Together with the embodiments of the present invention, the drawings are intended to explain the present invention, but not constitute any limitation to the present invention. In the drawings.

DETAILED DESCRIPTION OF EMBODIMENTS

Figure 1:
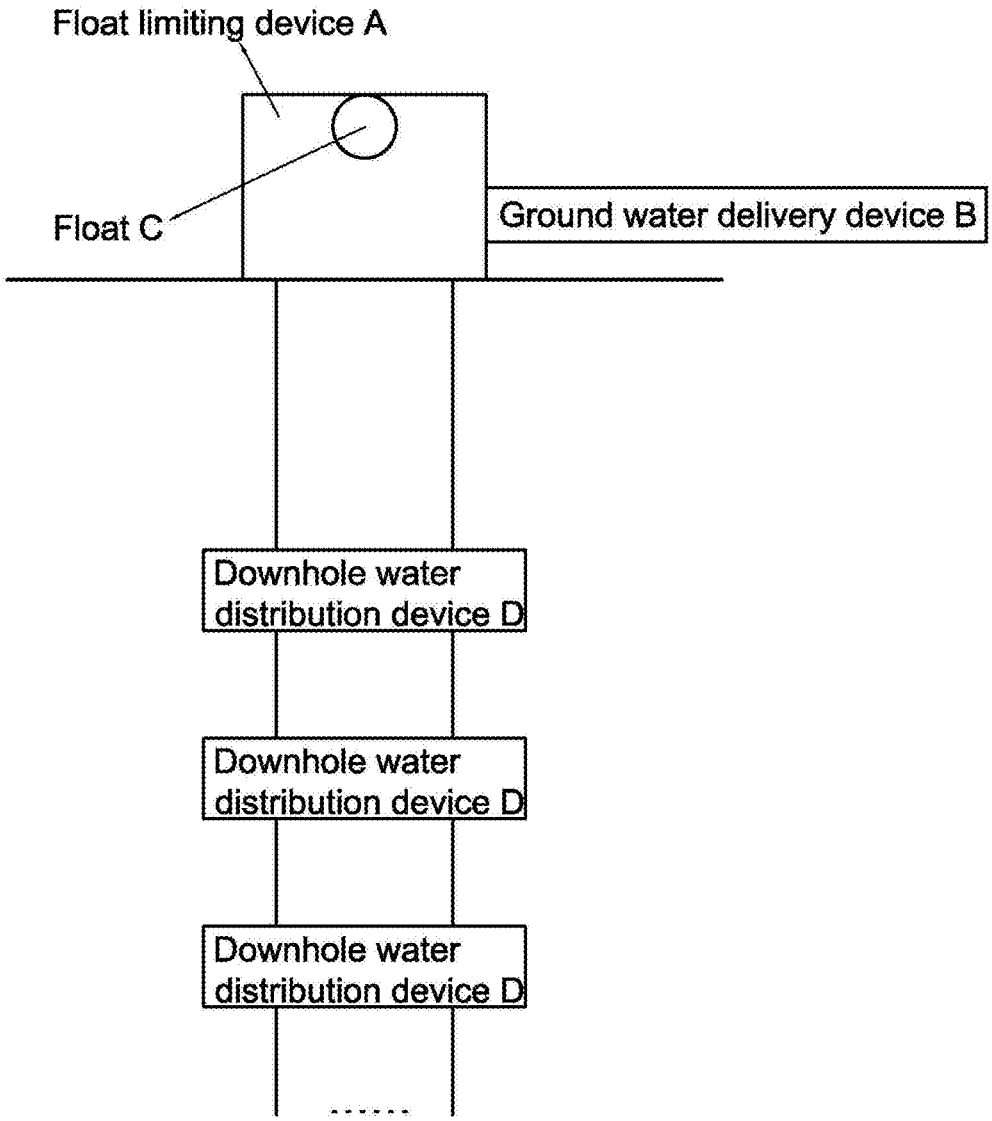
FIG. 1 schematically shows an overall structure of a water injection regulation system for a water injection well according to embodiments of the present application.

The implementation mode of the present invention will be explained in detail with reference to the embodiments and the accompanying drawings, whereby it can be fully understood how to solve the technical problem by the technical means according to the present invention, implement the technical solution, and achieve the technical effects thereof. It should be noted that all the embodiments and the technical features defined therein may be combined together if there is no conflict, and the technical solutions obtained in this manner shall all fall within the scope of protection of the present invention.

In addition, the steps illustrated in the flow chart in the drawings can be performed in a computer system containing a set of computer-executable instructions. Moreover, although a logical sequence is shown in the flow chart, in some cases these steps as shown or described may be performed in an order different than that shown herein.

In the later stage of oil field development, water injection is an important method for reservoir energy supplement. However, due to interlayer contradiction in the reservoir, general water injection will lead to uneven water absorption between layers, which cannot produce desirable water displacement. Therefore, layered water injection technology is of considerable importance. Layered water injection technology has gone through development stages of fixed layered water injection, movable layered water injection, eccentric layered water injection, bridge concentric layered water injection, and the latest generation of intelligent layered water injection.

Conventional layered water injection requires wireline operations to realize layered regulation, which is time-consuming and inefficient. In the meantime, downhole intelligent control devices mostly use cables for power supply and data transmission, resulting in complicated tripping process and high operation cost. Existing downhole intelligent water injection devices typically use electromagnetic waves or pressure pulses for command control and data transmission, which can be greatly affected by wellbore and formation conditions, and present poor adaptability to complex and deep reservoirs as well as complex well structures. Therefore, there is a need for a downhole intelligent data-transmission method which is less impacted by the environment with high data transmission efficiency, as well as a corresponding intelligent water injection system which has high stability, low construction difficulty, low operating cost, and dispenses with frequent maintenance.

In 2019, Tan Shaoxu et al. introduced a layered water injection system for offshore platform. The system carries out real-time data acquisition and flow control through downhole pressure sensor and hydraulic control sliding sleeve, thereby realizing ground and downhole monitoring and data exchange. The system uses a permanent downhole pressure gauge with two sensors for detecting minor fluctuations on pressure, temperature and flow in the casing and transmitting the acquired data to the ground via cables. However, cabled signal transmission tools will lead to difficult well entry operation, complex pipelines, pipeline damages, insulation failure of cables and other problems, which make downhole operations more difficult and time-consuming, and increase the cost thereof.

CN 201220122870.2 entitled "SUBDIVISION WATER INJECTION, BALL-OFF AND PROFILE CONTROL INTEGRATED TUBULAR COLUMN FOR WATER INJECTION WELL OF OILFIELD" discloses an integrated tubular column with profile control using ball, which performs water distribution and control for downhole layered water injection through dropping a ball at wellhead. However, this method can only control a specific amount of water injection with limited number of times. In addition, it is not possible to monitor, transmit and feed back downhole production data at the same time.

CN 201821966297.7 entitled "CABLE-CONTROLLED INTELLIGENT LAYERED WATER INJECTION DEVICE SYSTEM" discloses a cable-controlled intelligent layered water injection device system. The system controls the downhole intelligent injection allocation tool string through cables, thereby realizing water injection allocation of each layer and automatic segment flow measurement and adjustment during layered water injection. However, the device uses cables to transmit electrical signal and energy, making downhole construction more complicated. Moreover, the cables are susceptible to damage due to application conditions, which requires time-consuming operation and maintenance once damaged, leading to increased operation and maintenance costs.

CN 201821544813.7 entitled "INTELLIGENT STRATIFIED WATER INJECTION SYSTEM FOR WATER INJECTION WELL PRESSURE WAVE CODE" discloses a stratified water injection system for a water injection well pressure fluctuation code. In this system, the pressure wave code is transmitted to the water injection channel through the wellhead. The downhole precise flow monitoring device receives the wave code and commands the intelligent water injection system to carry out water distribution and regulation. This system solves problems such as high operating costs brought by traditional wireline, cable regulation and cabled intelligent water distribution system. On the other hand, the downhole flowmeter in this system is unstable and prone to damages. Moreover, since the conditions inside the well are complex, and the pressure wave can be easily affected by the environment, it is difficult to monitor error regulation. As a result, this system is difficult to be applied to complex wellbore and flow environment for signal regulation.

Therefore, the present application proposes a water injection regulation system and method for a water injection well, aiming to solve the above one or more technical problems. The system and method comprises a float limiting device, a ground water delivery device, an intelligent signal-exchange float for oil pipe, and a downhole intelligent measurement and regulation device for layered water distribution. The special signal-exchange float generally stays at the wellhead, and can move up and down freely in the water-injection string when in use. When the float moves to the intelligent measurement and regulation device at a water-injection segment, data can be exchanged, and the measurement and regulation device is driven to perform regulation operations through water nozzle. Meanwhile, the production monitoring data are collected, including downhole temperature, pressure, flow, etc. After completing information exchange between all measurement and regulation devices and production data collection, the float returns to the wellhead swiftly under buoyancy and then transmits the carried data. Therefore, the present invention is able to solve the problems concerning electromagnetic waves, pulse conductions and other technologies in existing wireless-transmission measurement and regulation devices that are easily affected by environmental factors and have limited applicable depth, and thus is of practical significance for high-efficiency and low-cost intelligent oil field.

It should be noted that in the embodiments of the present invention, "above" and "below" are directions opposite to each other. Specifically, a direction towards the sky is referred to as "above", and a direction towards the well is referred to as "below".

FIG. 1 schematically shows an overall structure of a water injection regulation system for a water injection well according to embodiments of the present application. As shown in FIG. 1, the water injection regulation system for the water injection well (hereinafter referred to as "water injection regulation system") according to embodiments of the present invention at least comprises a float limiting device A, a ground water delivery device B, a float C, and a plurality of downhole water distribution devices D. The float limiting device A is arranged at a wellhead, specifically at a wellhead of a water-injection string (water-injection wellbore) 11. Further, the float limiting device A has an internal space configured as a wellhead space, and a bottom portion (interior) in communication with the wellhead of the water-injection string 11. The ground water delivery device B is arranged at the ground surface, with an outlet thereof in communication with the internal space of the float limiting device A. Perforated sections within different injection layers are spaced apart through packers (see packers 13 and 15 in FIG. 2) at different depths between a casing 12 and the water-injection string 11. Each downhole water distribution device D is arranged in a different injection layer. Further, each downhole water distribution device D is provided at a perforated section (see perforated section 13 of a first target layer, TL1, and perforated section 16 of a second target layer, TL2, in FIG. 2) of a respective target layer, and is arranged around a sidewall of the water-injection string 11 where the corresponding target layer is located. In other words, a downhole water distribution device D is mounted on a region out of the water-injection string 11 corresponding to the perforated section in each injection layer.

Specifically, the float limiting device A is configured to restrict the float C provided at the wellhead, wherein the float C is released when a (float) activation instruction is received. Moreover, the float limiting device A is further configured to automatically capture the float C floating up to the wellhead. The ground water delivery device B is configured to inject water into the well via the float limiting device A and the water-injection string 11.

The float C is configured to receive a water distribution instruction to regulate the water (quantity) distribution of each downhole water distribution device D under a water distribution condition, and to enter the well with water flow after being released, as well as to actively float upwards to the wellhead after data collection is completed, so as to be restricted by the float limiting device A. It should be noted that in the embodiments of the present invention, the water injection regulation system has two working conditions, namely a water injection condition and the water distribution condition. The water distribution condition refers to a process of transmitting water distribution instruction and collecting production data corresponding to one or more downhole water distribution devices D performing downhole water distribution and/or production data collection, and the water injection condition refers to a process of injecting water with water distribution parameters (including injection outlet flow rate and/or injection outlet caliber) configured for downhole water distribution devices D in accordance with the water distribution condition.

Each downhole water distribution device D is configured to monitor the production data of the target layer in real time, and detect whether the float C is close to and passes through the corresponding water distribution device D in real time. When the float C is detected to be close to the perforated section of the target layer where it is located (i.e., when the float 3 is detected), the production data collected and stored by the current downhole water distribution device D are exchanged with the water distribution instruction carried by the float C (about the current downhole water distribution device D), so that the current downhole water distribution device D can carry out water distribution regulation on the current water injection layer based on the exchanged water distribution instruction, and the float C can obtain the production data after the information exchange, thereby completing production data collection for the current downhole water distribution device D.

Figure 2:
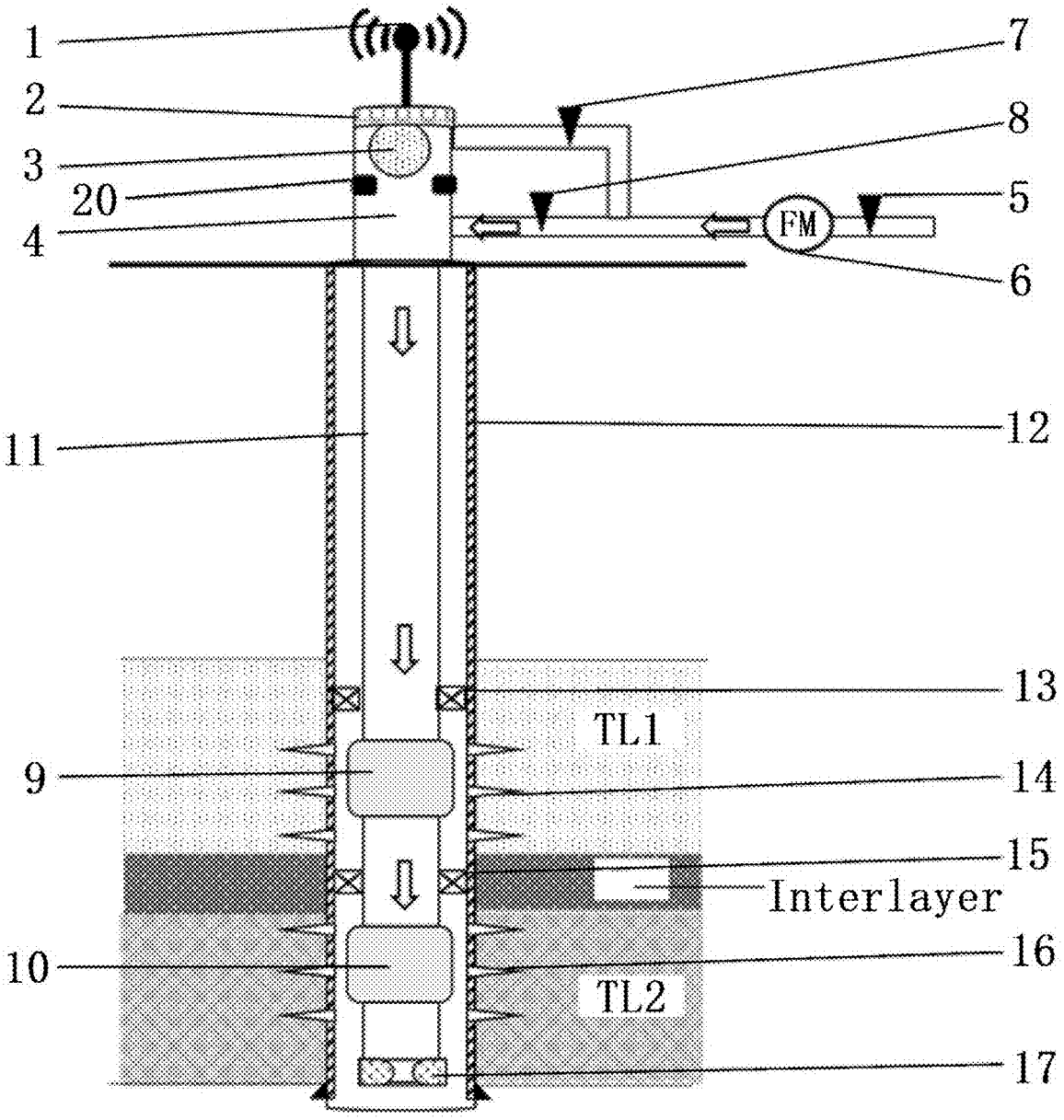
FIG. 2 schematically shows a detailed structure of the water injection regulation system for the water injection well in use according to embodiments of the present application.

FIG. 2 schematically shows a detailed structure of the water injection regulation system for the water injection well in use according to embodiments of the present application. The detailed structure and functions of the water injection regulation system according to embodiments of the present invention will be described as follows with reference to FIGS. 1 and 2.

As shown in FIG. 2, the float limiting device A, as an intelligence wellhead device of the water injection regulation system, at least comprises a wellhead device 4, a capture device 2, and a wellhead signal-exchange device 1. The wellhead device 4 is in communication with the outlet of the ground water delivery device B, and a bottom portion of the wellhead device 4 is in communication with the wellhead of the water-injection string 11. The capture device 2 is provided at an upper end portion of the wellhead device 4. The wellhead signal-exchange device 1 is provided outside the wellhead device 4 and on an upper end surface of the capture device 2. The ground water delivery device B, which is in communication with a water injection device (not shown) and as a water delivery pipeline device of the water injection regulation system, is mainly configured to deliver water stored in the water injection device to the wellhead of the water-injection string 11, so as to inject water to the well via the water-injection string 11.

The wellhead device 4 is configured as a hollow housing for accommodating the float C (indicated by reference sign 3 in FIG. 2) at the wellhead. The capture device 2 is an intelligent wellhead float-capture device, for restricting and releasing the float 3. The wellhead signal-exchange device 1, an intelligent wellhead signal-exchange device, communicates with the float 3. The wellhead signal-exchange device 1 is configured to enable the float 3 to obtain water distribution instructions with regard to one or more downhole water distribution devices D requiring water distribution regulation via the communication with the float 3, and to access all production data collected by the float.

Specifically, under a normal water injection condition, the float 3 is restricted by the capture device 2 at the wellhead. When downhole water distribution and/or production data collection is required for one or more downhole water distribution devices, the wellhead signal-exchange device 1 sends an activation instruction to the capture device 2, which releases the float 3 in response to the activation instruction.

Additionally, in the embodiments of the present invention, the wellhead signal-exchange device 1 is provided with a smart antenna. Since the float 3 returns to the wellhead under buoyancy after completing production data collection of all downhole water distribution devices D, the wellhead signal-exchange device 1 according to the embodiments of the present invention is further configured to detect in real time, via the smart antenna, a signal intensity of a first detection signal (see below) emitted by the float 3 in real time, thereby detecting in real time whether the float 3 is close to the capture device 2. When detecting that the float 3 is approaching the capture device 2, the wellhead signal-exchange device 1 immediately generates a capture instruction, which is sent to the capture device 2. Then, the capture device 2 restricts the float 3 at the wellhead in response to the capture instruction.

Figure 3:
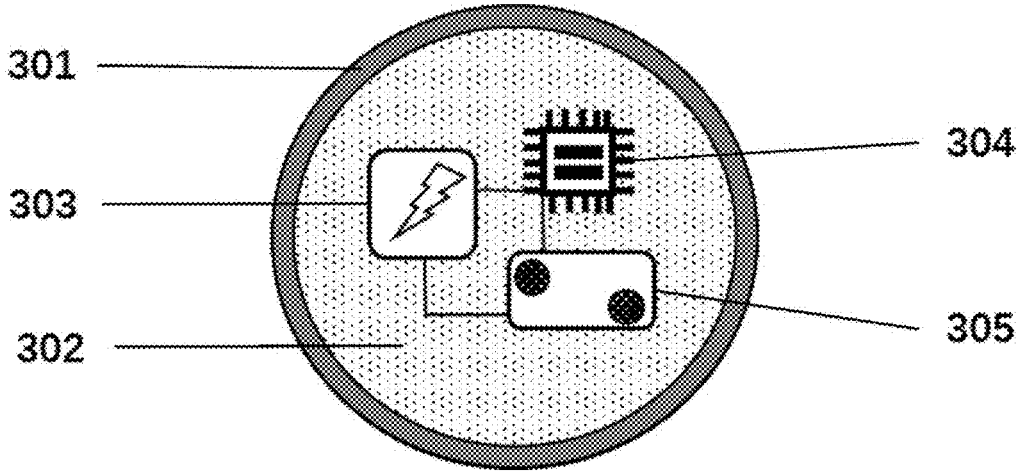
FIG. 3 schematically shows a structure of a float in the water injection regulation system for the water injection well according to embodiments of the present application.

FIG. 3 schematically shows a structure of a float in the water injection regulation system for the water injection well according to embodiments of the present application. As shown in FIG. 3, the float 3, as an intelligent signaling float device in the water injection regulation system, at least comprises a pressure-bearing housing 301, a first signal transceiver device 305, a first data storage and processing device 304, and a lightweight insulating filling portion 302. The pressure-bearing housing 301, which is made of pressure-bearing material, is configured as a hollow housing. The first signal transceiver device 305 and the first data storage and processing device 304 are both provided within an interior of the pressure-bearing housing 301. The interior (remaining) space of the pressure-bearing housing 301 is fully filled to form the lightweight insulating filling portion 302. The first data storage and processing device 304 is electrically connected to and communicates with the first signal transceiver device 305. In addition, the float 3 according to the embodiments of the present invention further comprises a first power supply device 303, which supplies power required for normal operations of the first signal transceiver device 305 and the first data storage and processing device 304.

Further, the intelligent signaling float 3 according to the embodiments of the present invention has a density less than water, and is able to float up and down freely in water with low flow rate or in still water. Moreover, the float 3 has a size slightly smaller than a cross-sectional size of the water-injection string 11. Thus, the float 3 is able to move up and down in the water-injection string 11, and flow along with the water flow based on the injection rate under the normal water injection condition, thereby moving toward the downhole in the water-injection string 11.

Further, the first signal transceiver device 305 is configured to continuously emit the first detection signal. Preferably, the first signal transceiver device 305 is further configured to continuously emit the first detection signal upon receiving the activation instruction. The first detection signal is preferably an ultrasonic signal. It should be noted that the signal strength of the first detection signal needs to be minimized to ensure longer battery life as well as normal communication.

Further, the first data storage and processing device 304 is in communication with the first signal transceiver device 305. The first data storage and processing device 304 is configured to wirelessly communicate with a downhole water distribution device D in cooperation with the first signal transceiver device 305 when approaching said underwater water distribution device D of the target layer for water distribution, in order to exchange the information of a water distribution instruction and production data for the current downhole water distribution device D.

Figure 4:
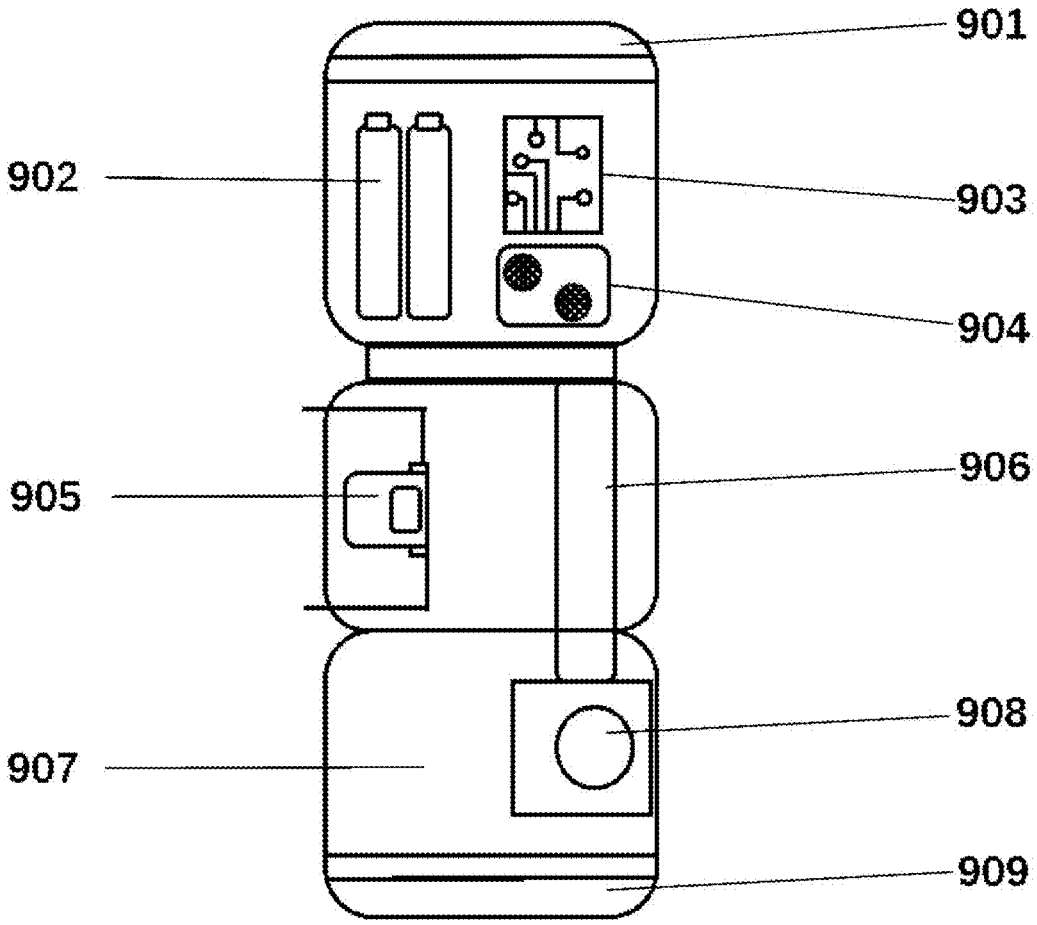
FIG. 4 schematically shows a structure of a downhole water distribution device in the water injection regulation system for the water injection well according to embodiments of the present application.

FIG. 4 schematically shows a structure of the downhole water distribution device in the water injection regulation system for the water injection well according to embodiments of the present application. The plurality of downhole water distribution devices D (i.e., those indicated by reference signs 9 and 10 respectively in FIG. 2) has a same structure. Specifically, as shown in FIG. 4, each of the downhole water distribution devices 9 and 10 comprises at least a water distribution body 907, an upper interface 901, a lower interface 909, a water injection outlet 908, a second signal transceiver device 904, a second data storage and processing device 903, and a power device 906.

As shown in FIG. 2, the water distribution body 907 is provided around the side wall of the water-injection string 11. As shown in FIG. 4, the second signal transceiver device 904, the second data storage and processing device 903 and the power device 906 all are provided on an inner wall of the water distribution body 907. The second signal transceiver device 904 is electrically connected to and communicates with the second data storage and processing device 903. The water injection outlet 908, which is in communication with the water-injection string 11, is provided on a side wall of the water distribution body 907. The water injection outlet 908 can be configured as an adjustable water nozzle. The power device 906 which is configured as an adjustable motor is electrically connected to both the water injection outlet 908 and the second data storage and processing device 903.

Further, each of the downhole water distribution devices 9 and 10 according to the embodiments of the present invention further comprises a second power supply device 902, and a production data monitoring device 905 which is connected to the second data storage and processing device 903 for continuously monitoring dynamic production data, such as temperature, pressure, and flow of the current injection formation. The obtained dynamic production data are sent to the second data storage and processing device 903 for storage. In this manner, the second data storage and processing device 903, when exchanging information with the float 3, directly transmits the stored dynamic production data to the first data storage and processing device 304 in the float 3 for storage. The second power supply device 902 provides power for the production data monitoring device 905, the second signal transceiver device 904, the second data storage and processing device 903 and the power device 906 for normal operation.

Further, the second signal transceiver device 904 is configured to detect the first detection signal in real time. Preferably, the second signal transceiver device 904 is further configured to send the first detection signal, upon detection thereof, to the second data storage and processing device 903. The second data storage and processing device 903 is in communication with the second signal transceiver device 904. The second data storage and processing device 903 is configured to, upon detection of the first detection signal, wirelessly communicate with the first data storage and processing device 304 in the float 3 via the first signal transceiver device 305 and the second signal transceiver device 904, thereby realizing information exchange between the water distribution instruction and the production data.

Further, the second data storage and processing device 903 is also configured to detect, in real time, the signal strength of the first detection signal emitted by the float 3 in real time via the second signal transceiver device 904, based on which whether the float 3 is close to the downhole water distribution device 9 or 10 of the current water injection layer (target layer) is detected in real time. When detecting that the float 3 is approaching the current downhole water distribution device 9 or 10 (e.g., the signal strength of the first detection signal is increasing), the second data storage and processing device 903 is configured to generate an arrival feedback signal immediately, which is transmitted to the first signal transceiver device 305 in the float 3 via the second signal transceiver device 904. In this case, the first data storage and processing device 304 in the float 3 receives the arrival feedback signal from the current downhole water distribution device 9 or 10 via the first signal transceiver device 305, and immediately initiates information exchange between the float 3 and the downhole water distribution device in the current water injection layer.

In addition, after the information exchange between the float 3 and the current downhole water distribution device is completed, the power device 906 in the current downhole water distribution device is further configured to receive water distribution instruction for the current water injection layer from the second data storage and processing device 903, and to adjust the rotational speed and/or the outlet caliber (outlet size) of the water injection outlet 908 according to the current water distribution instruction, so as to adjust the flow rate and/or the outlet caliber of the current water injection outlet, and thus complete the regulation of water distribution for the current water injection layer. In this case, as the float 3 is moving toward the downhole along with the water flow, the second data storage and processing device 903 in the current downhole water distribution device detects that the float 3 is leaving the current downhole water distribution device 9 or 10 (e.g., the signal strength of the first detection signal is weakening until it cannot be detected), so that the float 3 completes information exchange with the current downhole water distribution device (i.e., completes the collection of production data and regulation of water distribution of the current water injection layer at the same time), and then continues to move to the next water injection layer to complete information exchange with the downhole water distribution device in the next water injection layer.

Specifically, the first data storage and processing device 304 in the float 3, after receiving the arrival feedback instruction, immediately sends the water distribution instruction for the downhole water distribution device in the current water injection layer to the second signal transceiver device 904 in the current downhole water distribution device through the first signal transceiver device 305. Then, after receiving the water distribution instruction for the current water injection layer via the second signal transceiver device 904, the second data storage and processing device 903 in the current downhole water distribution device sends the water distribution instruction directly to the power device 906. In this case, the power device 906 regulates water distribution flow of the current water injection layer according to the current water distribution instruction on an as needed basis, so as to complete the regulation of water distribution for the current water injection layer. In the meantime, the second data storage and processing device 903 is further configured to transmit dynamic production data stored therein (having not been sent to the ground) for the current water injection layer to the first signal transceiver device 305 in the float 3 via the second signal transceiver device 904. Next, the first data storage and processing device 304 in the float 3 obtains and then stores the dynamic production data for the current water injection layer (to be transmitted to the ground) via the first signal transceiver device 305, thus completing the collection of the production data for the current water injection layer. Therefore, the information exchange between the water distribution instruction for the current water injection layer stored in the float 3 and the production data collected by the downhole water distribution device is completed, so that the float 3 completes collection of production data for the current water injection layer, and the current downhole water distribution device completes regulation of water distribution according to the exchanged water distribution instruction for the current water injection layer on an as needed basis.

Therefore, the intelligent signal float according to the present invention can exchange data with the signal transmission system in the downhole intelligent water distribution device, and at the same time, carry the downhole production feedback data to the wellhead for transmission by means of its chips with data access and storing functions, so that the ground obtains the monitored downhole production parameter data including temperature, pressure, flow, etc.

Further, the plurality of downhole water distribution devices D according to the embodiments of the present invention, as downhole intelligent water distribution devices in cooperation with the intelligent float C, can not only monitor the downhole production data, but also can exchange data with the intelligent float C, and adjust water distribution based on the received water distribution instructions.

The water injection regulation system according to the embodiments of the present invention further comprises an anti-escape device 17, which is provided at a bottom of the water-injection string 11. The anti-escape device 17 is configured to restrict the float 3 at the bottom after the float 3 passes through all downhole water distribution devices with the water flow.

As shown in FIG. 2, the anti-escape device 17 is attached to the string 11, and has a cylindrical structure. A through hole (not numbered) is formed between a top portion and a bottom portion of the anti-escape device 17 along its center axis. An anti-overflow screen is provided at a bottom of the anti-escape device 17. A top end surface and a bottom end surface of the through hole are horizontal and parallel to each other. Each of longitudinal edges on both sides of the through hole in its axial cross-section has a parabolic shape with an opening facing outward. A minimum inner diameter of the through hole is slightly smaller than an outer diameter of the float 3, and a maximum inner diameter thereof is slightly larger than the outer diameter of the float 3. In practice, when the float 3 passes through the last downhole water distribution device and enters the anti-escape device, the fluid flow area will become smaller due to the substantially reduced inner diameter of the anti-escape device (i.e., an inner diameter of the wellbore 11 reduced to the inner diameter of the through hole). Therefore, when the injection flow remains unchanged, the injection pressure at the wellhead will increase, based on which it can be determined that the float 3 has reached the bottom of the wellbore 11.

Thus, the anti-escape device 17 according to the embodiments of the present invention is able to block a downward movement of the float 3, so as to prevent the float 3 from moving away from the string 11. When the float 3 is stuck by the through hole and thus the pressure detected at the wellhead suddenly increases, the float limiting device A can identify the timing when the float 3 reaches the bottom of the wellbore 11, so that an instruction is immediately generated to stop water injection, thereby realizing cooperative control of the water injection regulation system and the water injection device.

In addition, the float limiting device A according to the present invention is further configured to monitor dynamic pressure in the device in real time, based on which the timing when the float 3 reaches the bottom of the wellbore is identified. At this time, an instruction to stop water injection is generated, so that the water injection device (not shown) connected to the ground water delivery device B stops water injection. Moreover, the float 3 is further configured to move from the bottom hole towards the wellhead under buoyancy in still water after the water injection device stops injecting water.

Specifically, the intelligent wellhead signal-exchange device 1 in the float limiting device A is capable of monitoring the internal dynamic pressure of the wellhead device 4 in real time. After the float 3 reaches the anti-escape device 17 at the bottom of the wellbore 11, the wellhead pressure will change significantly, and thus the timing when the float reaches the bottom of the wellbore 11 is detected. Afterwards, the instruction to stop water injection is generated immediately, which is sent to the water-injection device, so that the water injection device stops injecting water to the ground water delivery device B. Next, the flow rate of the injected water in the water-injection string 11 gradually decreases and tends to be stationary. In this case, the float 3 moves from the bottom hole towards the wellhead under buoyancy in still water. Thus, the capture device 2 is controlled to restrict the float 3 at the wellhead when the wellhead signal-exchange device 1 detects that the float 3 is approaching the capture device 2. Finally, the wellhead signal-exchange device 1 directly accesses the dynamic production data stored by the float 3 for all downhole water distribution devices. In this manner, the float 3 finishes transmitting a water distribution instruction and collecting the production data.

Further, the float limiting device A according to the embodiments of the present invention is an intelligent wellhead in cooperation with the float C, which has functions of capturing, restricting, releasing, signal exchange and data access of the float, ensures efficient transmission of the feedback data of the intelligent float, effectively improves the operation efficiency, and reduces the operation cost.

Again, as shown in FIG. 2, the ground water delivery device B according to the embodiments of the present invention comprises a first water injection line (not numbered) and a second water injection line (not numbered). An outlet of the first water injection line is in communication with a sidewall of the wellhead device 4 in the float limiting device A. An inlet of the first water injection line, as an inlet for water injection operation, is in communication with (a water storage tank of) the water injection device. A first end of the second water injection line is in communication with a sidewall of the first water injection line, and a second end of the second water injection line is in communication with the sidewall of the wellhead device 4 in the float limiting device A and is located at the outlet of the first water injection line. Since the first end of the second water injection line is in communication with the sidewall of the first water injection line, the first end of the second water injection line divides the first water injection line into two segments, namely a first line inlet segment and a first line outlet segment. Further, the second water injection line, as a bypass of the first line outlet segment, is connected in parallel with the first line outlet segment.

Specifically, the first water injection line is configured to be in communication with the wellhead device 4 under the water injection condition, and to be blocked from the sidewall of the wellhead device under the water distribution condition. In addition, the second water injection line is configured to be in communication with the wellhead device 4 under the water distribution condition. That is, under normal injection condition of the water injection regulation system, the water is delivered to the wellhead via the first water injection line for injection into the well. Under the water distribution condition of the water injection regulation system, the first line inlet segment is in communication with the second water injection line, through which the water is delivered to the wellhead for injection into the well. The communication between the first water injection line and the wellhead device 4 is switched to the communication between the second water injection line and the wellhead device 4 according to the capture instruction sent by the wellhead signal-exchange device 1 in the float limiting device A.

Further, the ground water delivery device B according to the embodiments of the present invention further comprises a first injection valve 5, a second injection valve 7 and a third injection valve 8 respectively connected to the intelligent wellhead (the float limiting device A). The first injection valve 5 is arranged adjacent to the inlet of the first water injection line, i.e., within the first line inlet segment, the second injection valve 7 is arranged within the second water injection line, and the third injection valve 8 is arranged adjacent to the outlet of the first water injection line, i.e. within the first line outlet segment. Thus, in the embodiments of the present invention, the float limiting device A can control the on/off states of the injection valves 5, 7 and 8 in a different manner, so that the water in the water injection device is delivered to the wellhead via different water injection lines under different working conditions, aiding in the water injection operation and the layered water distribution operation.

In addition, said float limiting device A further comprises a limiting member 20 which is made of elastic material and provided in a central part of an inner chamber of the wellhead device 4. The limiting member 20 is arranged on an inner wall in the central part of the wellhead device 4, and between an outlet end of the first water injection line and an outlet end of the second water injection line. The limiting member 20 and the capture device 2 jointly form a float limiting chamber for the float 3 within the wellhead device 4.

When the float 3 needs to operate, the first injection valve 5 and the second injection valve 7 are turned on, and the third injection valve 8 is turned off. In this case, the water flow enters the float limiting chamber of the capture device 2 through the first water injection line, and the float is forced to move away from the capture device 2 to the downhole under the water pressure. Then, the exchange between the water distribution instruction and the production data is completed. As the float 3 finishes the downhole signal exchange and moves upwards to the wellhead, the ground control system turns off the second injection valve 7 and turns on the third injection valve 8 according to the capture instruction generated by the wellhead signal-exchange device 1. In this case, the water flow enters the well via the second water injection line, and the float enters the capture device 2 under the water pressure, so that the capture device 2 completes the capture.

In addition, the ground water delivery device B according to the embodiments of the present invention further comprises a flow meter 6 connected to the intelligent wellhead (i.e., the float limiting device A), wherein the flow meter 6 is provided in the first line inlet segment. Further, the float limiting device A according to the embodiments of the present invention is also configured to detect the dynamic flow at an inlet end of the ground water delivery device B in real time, so that the flow rate of the injected water can be dynamically regulated according to the flow rate of the injected water pumped from the water injection device to the ground water delivery device B (first line inlet segment), and the flow rate required for the upward and downward movement of the float 3 in the water-injection string can be controlled flexibly.

Figure 5:
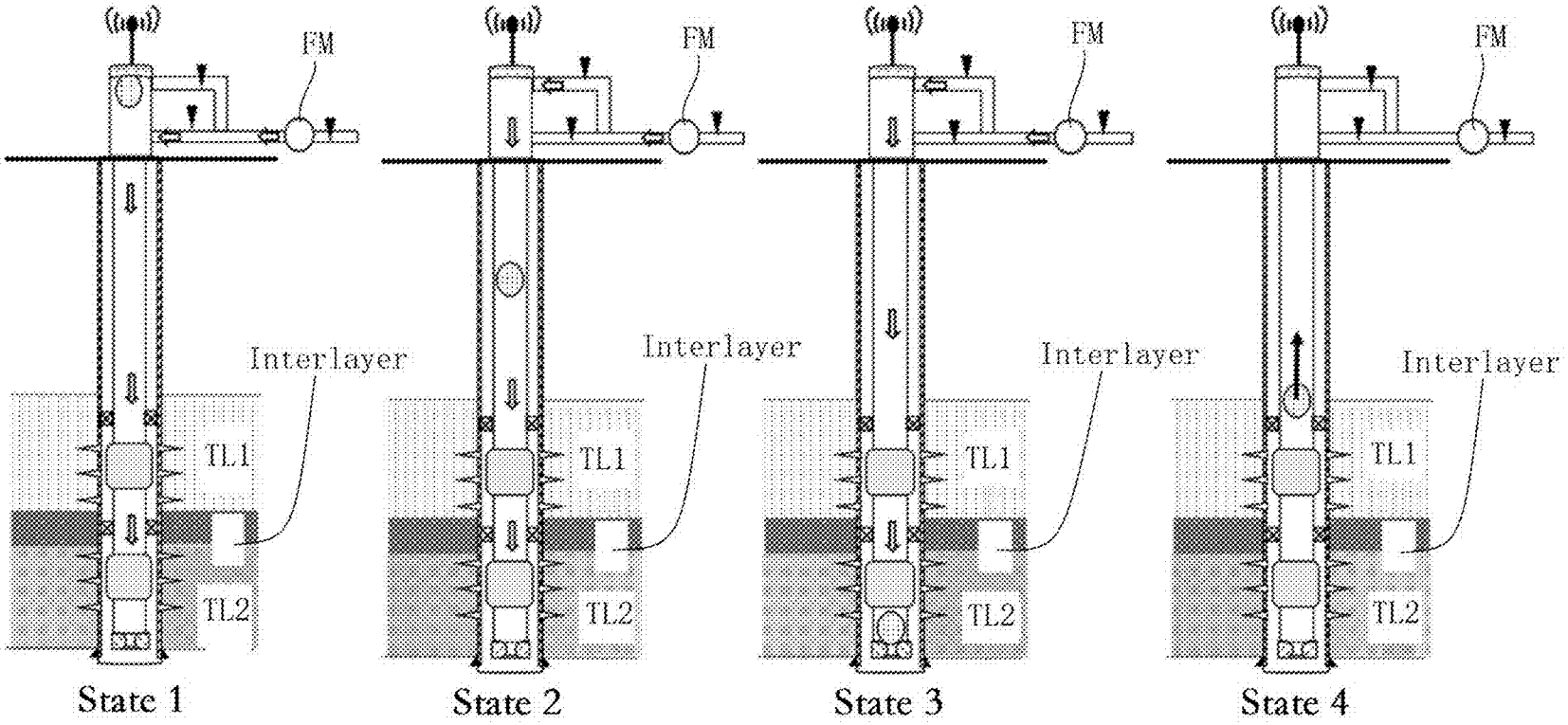
FIG. 5 schematically shows an operation process of the water injection regulation system for the water injection well according to embodiments of the present application.

FIG. 5 schematically shows an operation process of the water injection regulation system for the water injection well according to embodiments of the present application. A plurality of operating states of the water injection regulation system according to embodiments of the present invention will be described as follows with reference to FIG. 5.

Step 1. During the normal water injection condition, the intelligent float 3 is in a standby state, as shown in state 1 in FIG. 5. The injected water enters the water-injection string 11 after passing through the first injection valve 5, the flow meter 6, the third injection valve 8 and the wellhead device 4, and enters the target water injection layer after being regulated through the first downhole intelligent water distribution device 9 and the second downhole intelligent water distribution device 10.

Step 2. When downhole water distribution and/or production data collection is required, it is necessary to utilize the intelligent float 3, which is wrapped with the pressure-bearing housing 301, and comprises therein the power supply device 303, the data storage and processing system 304 and the signal transceiver device 305. The intelligent float is filled with the lightweight insulating filling portion 302, and has an overall density less than that of water, so that it is able to float in still water. The intelligent float is sized to be slightly smaller than the water injection tube, so that it can move up and down in the water injection string. When the float limiting device sends an actuation instruction through the intelligent wellhead antenna 1, the intelligent wellhead float capture device 2 releases the intelligent float 3. At this time, the third injection valve 8 is turned off, and the second injection valve 7 is turned on to switch the wellhead inlet for water injection. The intelligent float 3 will be washed away from the wellhead by the water flow after being released, and then enter the water-injection string 11, as shown in state 2 in FIG. 5. After the intelligent float 3 is released, the signal transceiver device 305 will continue to send weak signals to detect whether the intelligent float 3 is close enough to the first or the second downhole intelligent water distribution device.

Step 3. The intelligent float 3 passes through the first downhole intelligent water distribution device 9 and the second downhole intelligent water distribution device 10 along with the injected water during operation. The intelligent water distribution device 9 or 10 comprises the power supply device 902 with a built-in rechargeable battery, which can supply electric energy to the data processing and storage system 903, the signal transceiver device 904, the production data monitoring system 905, and the power device 906, etc. During the normal water injection condition, the production data monitoring system 905 continuously monitors temperature, pressure, flow and other data, and store them in the data processing and storage system 903. After the intelligent float 3 is released, weak detection signal is continuously sent to determine whether the intelligent float 3 is close enough to the intelligent water distribution device. When the intelligent float 3 is close to the intelligent water distribution device, the signal transceiver device 904 in the intelligent water distribution device receives the signal from the intelligent float 3. After the signal is processed by the data processing and storage system 903, the signal transceiver device 904 sends the arrival feedback signal. After receiving the feedback signal, the intelligent float 3 will exchange information with the downhole intelligent water injection device 9 or 10. Afterwards, the intelligent water distribution system drives the power device 906 to adjust the water injection outlet 908 according to the collected water distribution instruction, thereby completing the regulation of water distribution. After information exchange, the intelligent float 3 stores the downhole production parameter data transmitted from the intelligent water distribution device 9 or 10.

Step 4. As the water injection continues, the intelligent float 3 continues to move to the bottom of the string, and then is blocked by the anti-escape device 17 to be prevented from moving out of the string, as shown in state 3 in FIG. 5. At this time, the pressure of the wellhead tube changes, based on which the system can monitor and determine the timing when the float 3 reaches the bottom of the string.

Step 5. After the intelligent float 3 moves to the bottom of the string, the water injection is suspended. The intelligent float 3 will float freely in the string 11 under the buoyancy, as shown in state 4 in FIG. 5, until it reaches the wellhead device 4. The intelligent wellhead signal-exchange system 1 will sense the approach of the float 3 and command the intelligent wellhead float capture device 2 to capture and restrict the float.

Step 6. The intelligent float 3 transmits the carried production parameter data to the intelligent wellhead signal exchange system 1. Further, the intelligent wellhead signal exchange system 1 transmits the collected production data to the ground computer for effective storage. Then, the storage space in the float 3 is emptied, so that the float 3 enters the standby state, waiting for the next actuation. In this manner, the water injection regulation system according to the embodiments of the present invention completes a single operation.

Example 1

Due to changes in formation pressure, it is necessary to perform a downhole water distribution regulation to reduce the water injection volume to the target layer 1 and increase the water injection volume to the target layer 2. In the meantime, it is intended to collect downhole pressure, temperature and flow data.

In accordance with Step 1, the system is turned on. The intelligent float is activated with the required instruction, and released to continuously move downwards in the tube along with the water flow.

When approaching the target layer 1, the intelligent float transmits instruction and exchanges data with the intelligent water distribution device corresponding to the target layer 1. An instruction to reduce the water distribution valve is sent to the water distribution device and processed thereby, so that the outlet of the water flow is changed through mechanical action, and the temperature, pressure, and flow data of the target layer 1 is transmitted to the float.

After receiving and storing the above set of data, the intelligent float continues to move to the target layer 2, and also transmits instruction and exchanges data with the intelligent water distribution device corresponding to the target layer 2. An instruction to increase the water distribution valve is sent to the water distribution device and processed thereby, so that the outlet of the water flow is changed through mechanical action, and the temperature, pressure, and flow data of the target layer 2 is transmitted to the float.

The float is detected by the pressure system after moving to the bottom of the tube. Water injection is stopped to allow the float to move up freely, as described in Step 5. Then the float moves to the wellhead as described in Step 6, where it is restricted and the data is released. Thus, this operation is completed, successfully regulating the water distribution in the target layer and collecting downhole temperature, pressure and flow data within a certain period of time.

Figure 6:
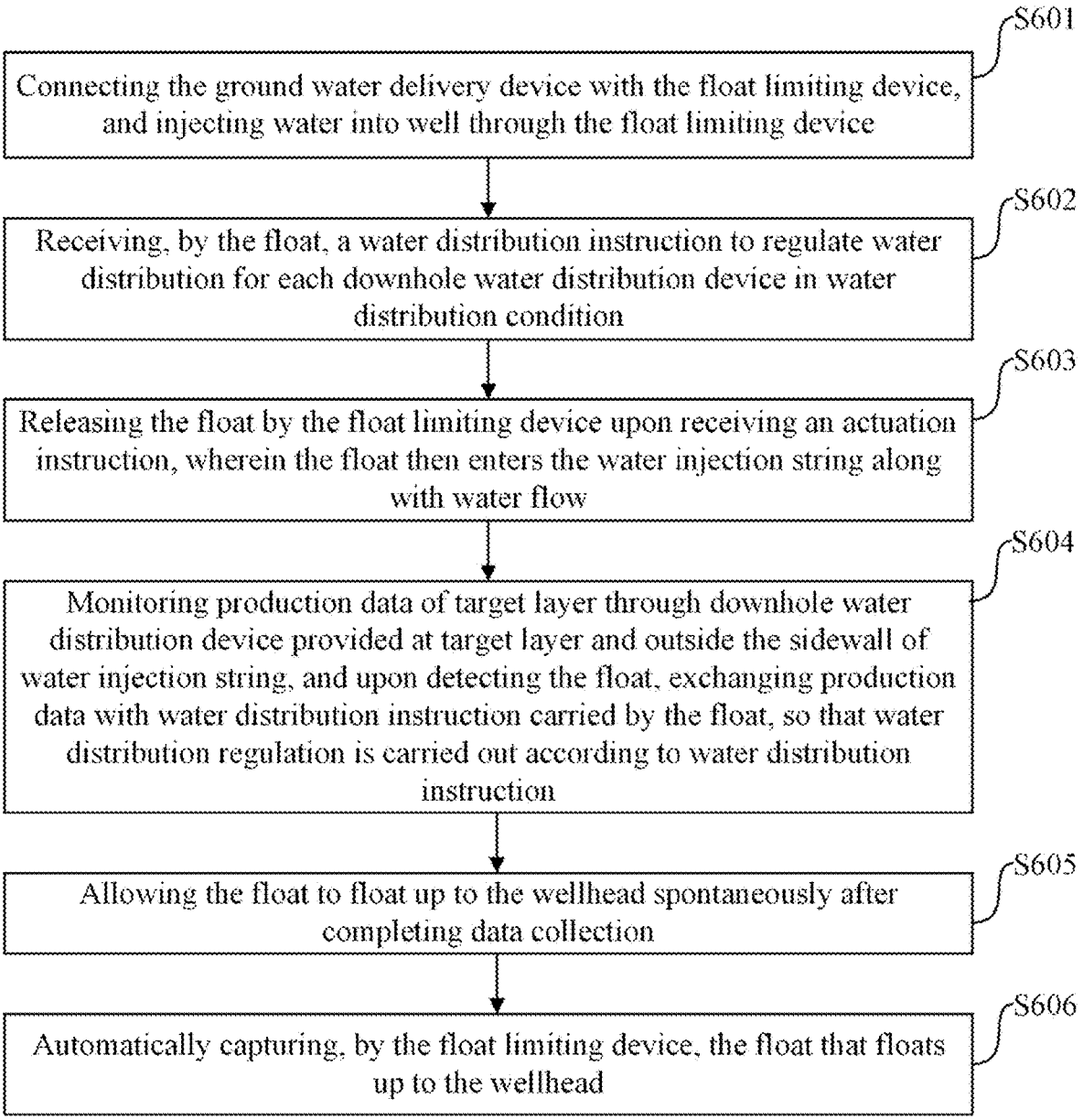
FIG. 6 shows steps of a water injection regulation method for the water injection well according to embodiments of the present application.

According to another aspect of the present invention, the embodiments of the present invention further propose a water injection regulation method for the water injection well (hereinafter referred to as "water injection regulation method") based on the above water injection regulation system. FIG. 6 shows steps of the water injection regulation method for the water injection well according to embodiments of the present application. As shown in FIG. 6, the water injection regulation method according to embodiments of the present invention is performed in the following steps.

Step S601. The ground water delivery device B is connected to the float limiting device A, so that water is injected into the well through the float limiting device A.

Step S602. In the water distribution condition, the float C receives a water distribution instruction to regulate water distribution for each downhole water distribution device.

Step S603. Upon receiving an actuation instruction, the float limiting device A releases the float C, which then enters the water injection string along with the water flow.

Step S604. The downhole water distribution device D provided at the target layer and outside the sidewall of the water injection string monitors the production data of the target layer. Upon detecting the float C, the current production data are exchanged with the water distribution instruction carried by the float C, so that water distribution regulation is carried out for the current layer according to the exchanged water distribution instruction.

Step S605. The float C actively floats up to the wellhead after completing data collection.

Step S606. The float limiting device A automatically captures the float C that floats up to the wellhead.

The present invention proposes a water injection regulation system and method for the water injection well. The system and method can achieve intelligent water injection regulation through carrying out downhole data transmission and water injection regulation by means of an intelligent float, thus realizing intelligent real-time wireless measurement and regulation as well as data monitoring for each water injection section of a layered water injection well. With a special downhole data and signal bidirectional transmission method, the present invention shortens distances of data transmission and signal control, so that exchange and transmission for data and instructions are less affected by the environment, allowing for faster and more stable data exchange. Therefore, the present invention is able to solve the problems concerning electromagnetic waves, pulse conductions and other technologies in existing wireless-transmission measurement and regulation devices that are easily affected by environmental factors and have limited applicable depth, and thus is of practical significance for high-efficiency and low-cost intelligent oil field.

The foregoing is merely illustrative of preferred embodiments of the present invention, but the scope of protection of the present invention is not limited thereto. Any modifications or substitutions that can be readily conceived by one skilled in the art within the technical scope disclosed herein shall fall within the scope of protection of the present invention. Therefore, the scope of protection of the present invention should be determined according to the scope of protection of the claims.

It should be understood that the embodiments of the present invention are not limited to the specific structures, processing steps or materials disclosed herein, but should extend to equivalent substitutions of these features understood by one ordinarily skilled in the art. It should also be understood that the terminology used herein is for the purpose of describing a particular embodiment only, rather than being construed as restriction.

The phrase "an embodiment" or "embodiments" as mentioned in the description means that the particular features, structures or characteristics described in conjunction with the embodiment or embodiments are included in at least one embodiment of the present invention. Thus, the phrase "an embodiment" or "embodiments" used throughout the description does not necessarily refer to the same embodiment.

Although the embodiments of the present invention are described hereinabove, the disclosure is provided for facilitating to understand the implementing mode of the present invention, but rather restricting the present invention. Without departing from the spirit and scope of the present disclosure, one skilled in the art can make various modifications and improvements in forms and details of the implementing mode. The scope of protection of the present invention shall be determined by the appending claims.

The invention claimed is:

1. A water injection regulation system for a water injection well, comprising:

a float limiting device provided at a wellhead of the well, which is configured to release a float upon receiving an activation instruction, and to capture the float floating up to the wellhead;

a ground water delivery device, which has an outlet in communication with an interior of the float limiting device, and is configured to inject water into the well through the float limiting device; and a plurality of downhole water distribution devices, each of which is arranged in a target layer and outside a sidewall of a water-injection string, and configured to monitor production data of the target layer, wherein the float is configured to receive a water distribution instruction to regulate water distribution of each downhole water distribution device, enter the water-injection string with water flow after being released, and float upwards to the wellhead after data collection is completed, and each of the plurality of downhole water distribution devices is configured to transmit the production data to and receive the water distribution instruction from the float when detecting the float to perform water distribution regulation according to the water distribution instruction.

2. The water injection regulation system according to claim 1, wherein the float limiting device comprises:

a wellhead device in communication with an outlet of the ground water delivery device, wherein a bottom portion of the ground water delivery device is in communication with the wellhead for accommodating the float at the wellhead;

a capture device provided at an upper end portion of the wellhead device for restricting and releasing the float; and a wellhead signal-exchange device, which is arranged on the capture device and outside the wellhead device, and configured to communicate with the float so that the float receives the water distribution instruction, and to access the production data collected by the float.

3. The water injection regulation system according to claim 2, wherein the wellhead signal-exchange device is further configured to communicate with the capture device, for sending the activation instruction to the capture device, detecting whether the float is close to the capture device in real time, and generating a capture instruction when the float is detected, thereby sending the capture instruction to the capture device.

4. The water injection regulation system according to claim 1, wherein the float comprises:

a pressure-bearing housing;

a first signal transceiver device provided within the pressure-bearing housing, and configured to continuously emit a first detection signal;

a first data storage and processing device provided within the pressure-bearing housing, which is connected to the first signal transceiver device, and is configured to communicate, when approaching the downhole water distribution device arranged in the target layer, with said downhole water distribution device in a wireless manner through the first signal transceiver device, thereby realizing data transmission between the float and one or more of the plurality of downhole water distribution devices; and an insulating filling portion within the pressure-bearing housing.

5. The water injection regulation system according to claim 4, wherein the downhole water distribution device comprises:

a water distribution body provided on a sidewall of the water-injection string, wherein the water distribution body has an upper interface and a lower interface;

a water injection outlet in communication with the water-injection string and arranged on a sidewall of the water distribution body;

a second signal transceiver device;

a second data storage and processing device, which is connected to the second signal transceiver device and configured to communicate in a wireless manner with the float when the first detection signal is detected, thereby realizing information exchange between the water distribution instruction and the production data; and a power device, which is connected to both the water injection outlet and the second data storage and processing device, and is configured to regulate a flow rate and/or a size of the water injection outlet according to the water distribution instruction.

6. The water injection regulation system according to claim 1, wherein the water injection regulation system further comprises an anti-escape device, which is provided at a bottom of the string and is configured to restrict the float at the bottom of the string after the float passes through the plurality of downhole water distribution devices with water flow.

7. The water injection regulation system according to claim 6, wherein a through hole is formed between a top portion and a bottom portion of the anti-escape device along its center axis, wherein each of longitudinal edges on both sides of the through hole in its axial cross-section has a parabolic shape with an opening facing outward, the through hole having a minimum inner diameter smaller than an outer diameter of the float, and a maximum inner diameter larger than the outer diameter of the float.

8. The water injection regulation system according to claim 1, wherein the ground water delivery device comprises:

a first water injection line, an outlet thereof being in communication with a sidewall of the wellhead device in the float limiting device, wherein the first water injection line is configured to be in communication with the wellhead device and is blocked from the sidewall of the wellhead device; and a second water injection line, which has a first end in communication with a sidewall of the first water injection line, and a second end in communication with the sidewall of the wellhead device in the float limiting device and configured to be in communication with the wellhead device, wherein a communication between the first water injection line and the wellhead device is switched to a communication between the second water injection line and the wellhead device according to the capture instruction sent by the float limiting device.

9. The water injection regulation system according to claim 8, wherein the ground water delivery device further comprises:

a first injection valve arranged adjacent to an inlet of the first water injection line;

a second injection valve within the second water injection line; and a third injection valve arranged adjacent to the outlet of the first water injection line.

10. The water injection regulation system according to claim 1, wherein the float limiting device is further configured to monitor a dynamic pressure in the water injection regulation system to determine a timing when the float reaches the bottom of the string, based on which an instruction to stop water injection is generated to cause a water injection device to stop water injection.

11. The water injection regulation system according to claim 10, wherein the float is further configured to move, after the water injection device stops water injection, from the bottom of the string to the wellhead in still water under buoyancy.

12. A water injection regulation method for a water injection well, performed by means of the water injection regulation system according to claim 1, wherein the water injection regulation method comprises steps of:

connecting the ground water delivery device with the float limiting device, and injecting water into the well through the float limiting device;

receiving, by the float, a water distribution instruction to regulate water distribution for each of the plurality of downhole water distribution devices;

releasing the float by the float limiting device upon receiving an actuation instruction; to cause the float to enter the water injection string;

monitoring the production data of the target layer through the plurality of downhole water distribution devices provided at the target layer and outside the sidewall of the water injection string, and upon detecting the float, exchanging the production data with the water distribution instruction carried by the float to carry out water distribution regulation;

floating the float up to the wellhead; and automatically capturing the float by the float limiting device after completing data collection.

* * * * *